United States Patent [19]

Karol

[11] Patent Number: 4,795,479

[45] Date of Patent: Jan. 3, 1989

[54] FUEL COMPOSITIONS CONTAINING TERPENE DERIVATIVES OF 2,5-DIMERCAPTO-1,3,4-THIADIAZOLE

[75] Inventor: Thomas J. Karol, Norwalk, Conn.

[73] Assignee: R. T. Vanderbilt Company, Inc., Norwalk, Conn.

[21] Appl. No.: 188,921

[22] Filed: May 2, 1988

[51] Int. Cl.[4] ..... C10L 1/22; C10L 1/24

[52] U.S. Cl. ..... 44/63; 44/57; 44/64; 44/76

[58] Field of Search ..... 44/63, 64

[56] References Cited

U.S. PATENT DOCUMENTS

| | | | |
|---|---|---|---|
| 2,736,729 | 2/1956 | Krzikalla et al. | 260/302 |
| 2,764,547 | 9/1956 | Fields | 252/32.7 |
| 3,609,079 | 9/1971 | Devine et al. | 252/46.3 |
| 3,663,561 | 5/1972 | Blaha | 44/63 |
| 4,136,043 | 1/1979 | Davis | 252/47 |
| 4,410,436 | 10/1983 | Holstedt et al. | 252/46.4 |
| 4,632,674 | 12/1986 | Martella | 44/63 |
| 4,761,482 | 8/1988 | Karol | 252/47 |

FOREIGN PATENT DOCUMENTS 943790 6/1956 Fed. Rep. of Germany .

OTHER PUBLICATIONS

Fields, *Addition of* 1,3,4-*Thiadiazole*-2,5-*Dithiol to Olefinic Compounds*, 21, J. Org. Chem., 497-9 (1956).

*Primary Examiner*—William R. Dixon, Jr.
*Assistant Examiner*—Ellen McAvoy
*Attorney, Agent, or Firm*—Rasma B. Balodis

[57] ABSTRACT

A diesel fuel composition comprising a major portion of middle distillates and a minor wear improving amount of a reaction product of one mole of a terpene and one mole of 2,5-dimercapto-1,3,4-thiadiazole which may be further reacted in the 5-position with one mole of terpene or one mole of alkyl, hydroxyalkyl, phenylalkyl and alkylated phenylalkyl compound.

4 Claims, No Drawings

FUEL COMPOSITIONS CONTAINING TERPENE DERIVATIVES OF 2,5-DIMERCAPTO-1,3,4-THIADIAZOLE

BACKGROUND OF THE INVENTION

The present invention concerns improved fuel compositions. More particularly, it relates to diesel fuel compositions having improved wear resistance.

Internal combustion engines are susceptible to wear in the upper cylinder region. It is believed that the majority of wear occurring in the upper cylinder is caused by the upward motion of the piston. While lubricating oils prevent wear on the downward stroke, the lubricating oil has limited or essentially no contact with the cylinder wall on the upward motion. During the upward compression stroke, particularly in diesel engines, the fuel is in contact with the cylinder wall and can influence its wear.

Accordingly, it is an object of the invention to provide diesel fuel having improved antiwear properties.

It is known that terpene derivatives of 2,5-dimercapto-1,3,4-thiadiazole impart antioxidant and antiwear properties to lubricating oils as described in U.S. patent application Ser. No. 041,496 filed Apr. 23, 1987.

It has been now discovered that terpene dervatives of 2,5-dimercapto-1,3,4-thiadiazole impart antiwear properties to diesel fuel.

SUMMARY OF THE INVENTION

In accordance with the invention, there are provided diesel fuel compositions having improved antiwear properties and comprising a major portion of a diesel fuel and a minor wear resistance imparting portion of a reaction product of a terpene compound and 2,5-dimercapto-1,3,4-thiadiazole selected from the group of compounds having the structural formula

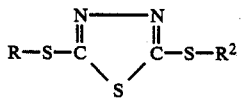

wherein R represents pinene residue of the formula

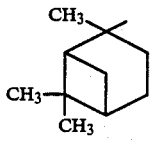

and limonene residue of the formula

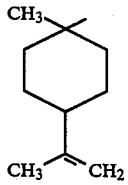

and $R^2$ may be the same as R or hydrogen, alkyl, hydroxyalkyl, alkylthio, phenylalkyl and alkylated phenylalky groups.

DESCRIPTION OF SPECIFIC EMBODIMENTS

The reaction products of the invention may be prepared by reacting one mole of 2,5-dimercapto-1,3,4-thiadiazole with one or two moles of terpene according to the method described in U.S. Pat. No. 2,764,547. The monoterpene derivatives may be prepared by reacting one mole of 2,5-dimercapto-1,3,4-thiadiazole with one mole of terpene at about 80° C. to 170° C. followed by alkylation by known methods. Alternately, the two reactions may be performed in a reverse order. The 2-hydroxyalkyl substituted derivatives may be prepared by reacting 2,5-dimercapto-1,3,4-thiadiazole with the corresponding expoxide. The reaction may be conducted in the presence of an inert solvent such as alcohols, toluene and benzene and a reaction promoter as for example, alkyl sulfonic acids. The reaction temperature will depend upon the specific reactants and solvent media employed. Typically reaction temperature will range from about 80° C. to 140° C.

The alkyl group $R^2$ in the formula I represents an alkyl group having from 1 to 50 carbon atoms and a straight and branched chain including alkyls substituted by a hydroxy group and an aryl group. These include, among others, methyl, ethyl, n-propyl, isopropyl, n-butyl, isobutyl, sec-butyl, pentyl, octyl, dodecyl, octadecyl, benzyl, 2-phenylethyl, and 2-hydroxyhexadecyl groups.

The reaction products may be added to diesel fuel in an effective amount to impart antiwear properties. The effective amount may range from about 0.001 to 2.0 percent and preferably from about 0.01 to 1.0 percent.

Diesel fuels are petroleum refinery products commonly known as middle distillates. These fuels are complex mixtures of many different hydrocarbons. The properties of commercial diesel fuels depend on the refining process and the nature of the crude oil from which it is derived. Generally, the boiling range of the fuels is between 163° to 400° C. and the kinematic viscosity at 40° C. ranges between 1.3 to 24.0 cSt.

The preferred diesel fuels are fuel oils complying with ASTM specifications compiled in Table I.

TABLE I

Specifications for Diesel Fuel Oils, ASTM D975-78

| Property | Grade 1-D | Grade 2-D | Grade 4-D |
|---|---|---|---|
| Distillation (90%) point, °C. | 288 max. | 282–338 | — |
| Flash point, °C. | 38 | 52 | 55 |
| Viscosity at 40° C., kinematic, $mm^2/s$ (= cSt) | 1.3–2.4 | 1.9–4.1 | 5.5–24.0 |
| Cetane number, min. | 40 | 40 | 40 |

The properties of the fuel affect directly the power, economy, performance and wear of the engine. In addition to the wear inhibiting additive, diesel fuels may contain other additives to enhance their properties. These additives may be ignition quality improvers, oxidation inhibitors, biocides, rust preventives, metal deactivators, pour point depressors, emulsifiers, smoke suppressants and dispersants.

The following examples are given for the purpose of further illustrating the invention. All percentages and parts are based on weight unless otherwise indicated.

EXAMPLE I

The additives of the invention were evaluated by the Shell Four-Ball Wear Test.

The test was conducted essentially according to the method described in ASTM D-2266 procedure. Four lightly polished steel balls 12.5 mm in diameter were placed in a test cup and submerged in the test sample. The test fuel was D-2 diesel fuel manufactured by Texaco, Inc. The test was carried out at a rotation speed of 1800 rpm under a load of 40 kg for one hour at 93.3° C.

The additives of the invention were added to the oil in the amount indicated in Table II. Fuel compositions containing the present additives show improved antiwear properties.

TABLE II

| FOUR-BALL WEAR TEST | | | |
|---|---|---|---|
| Sample | Active Ingredient | Percent | Scar, mm |
| 1 | None | — | 1.82 |
| 2 | 2,5-Bis(2-pinanylthio)-1,3,4-thiadiazole | 0.50 | 0.92 |

The above embodiments have shown various aspects of the present invention. Other variations will be evident to those skilled in the art and such modifications are intended to be within the scope of the invention as defined by the appended claims.

What is claimed is:

1. A diesel fuel composition characterized by improved wear properties and comprising a major portion of middle distillates boiling in the range of about 163° C. to 400° C. and a minor wear improving amount of a reaction product of a terpene and 2,5-dimercapto-1,3,4-thiadiazole selected from the group of compounds having the structural formula

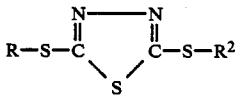

wherein R represents pinene residue of the formula

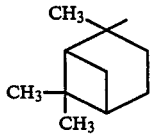

and limonene residue of the formula

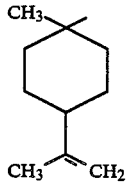

and $R^2$ may be the same as R or hydrogen, alkyl, hydroxyalkyl, alkylthio, phenylalkyl and alkylated phenylalkyl groups.

2. The fuel composition of claim 1 wherein the reaction product is present in the amount ranging from 0.001 to 2.0 percent by weight based on the weight ot the fuel composition.

3. The fuel composition of claim 1 wherein the reaction product is 2,5-bis(2-pinanylthio)-1,3,4-thiadiazole.

4. A method of improving the wear resistance of a diesel fuel which comprises adding to diesel fuel about 0.001 to 2.0 percent of a reaction product of a terpene and 2,5-dimercapto-1,3,4-thiadiazole selected from the group of compounds having the structural formula

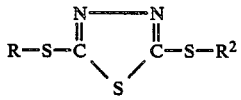

wherein R represents pinene residue of the formula

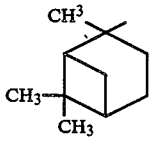

and limonene residue of the formula

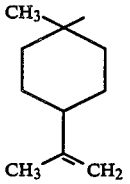

and $R^2$ may be the same as R or hydrogen, alkyl, hydroxyalkyl, alkylthio, phenylalkyl and alkylated phenylalkyl groups.

* * * * *

UNITED STATES PATENT AND TRADEMARK OFFICE

CERTIFICATE OF CORRECTION

PATENT NO. : 4,795,479

DATED : January 3, 1989

INVENTOR(S) : Thomas J. Karol

It is certified that error appears in the above-identified patent and that said Letters Patent is hereby corrected as shown below:

Column 1, line 68
"phenylalky" should be -- phenylalkyl --;

Claim 2, column 4, line 15
"ot the fuel" should be -- of the fuel --.

Signed and Sealed this

Fourth Day of July, 1989

*Attest:*

*Attesting Officer*

DONALD J. QUIGG

*Commissioner of Patents and Trademarks*